US005927015A

United States Patent [19]

Ghosn et al.

[11] Patent Number: 5,927,015

[45] Date of Patent: Jul. 27, 1999

[54] POWERED DOOR DRIVE SYSTEM AND LOCK

[75] Inventors: Michel Ghosn, Saint Laurent; Nitai Friedman, Montreal; Daniel Beaulieu, Monteal, all of Canada

[73] Assignee: Vapor Canada, Inc., Quebec, Canada

[21] Appl. No.: 08/744,341

[22] Filed: Nov. 7, 1996

[51] Int. Cl.[6] ..... B61L 29/08

[52] U.S. Cl. ..... 49/291; 49/301

[58] Field of Search ..... 49/280, 279, 291, 49/292, 293, 295, 296, 298, 300, 301, 302

[56] References Cited

U.S. PATENT DOCUMENTS

| | | | |
|---|---|---|---|
| 689,044 | 12/1901 | Formes | 49/301 |
| 807,921 | 12/1905 | Ganzenmüller | 49/301 |
| 1,223,956 | 4/1917 | Ganzenmüller | 49/301 |
| 2,072,077 | 3/1937 | Bianco | 49/301 |

*Primary Examiner*—Jerry Redman
*Attorney, Agent, or Firm*—James Ray & Assocs.

[57] ABSTRACT

Automatic door system for mass transit vehicles utilizing a linear induction motor for powering door panels from open to closed. A power actuated panel lock provides positive panel locking and unlocking through actuating the prime mover.

7 Claims, 11 Drawing Sheets

POWERED DOOR DRIVE SYSTEM AND LOCK

BACKGROUND OF THE INVENTION

AND DESCRIPTION OF RELATED ART, INCLUDING INFORMATION DISCLOSED UNDER 37 C.F.R. 1.97–1.99

Power door drives or operators for mass transit vehicles are in widespread use throughout the world. The systems now in use can be broadly divided by the specific energy source for the system prime mover or door drive. The invention disclosed herein pertains generally to door drives employing electrically powered devices as prime movers.

Generally speaking, electrical drives utilize highly reliable rotary electric motors operating doors through intermediate devices. These intermediate devices convert rotary motion of the drive motor to linear and/or other movement required to move the vehicular door panels. Intermediate devices as contemplated herein can further be categorized as mechanical linkages or rotary helical drive systems.

While reliable and reasonably cost effective, a major shortcoming of the above described drive systems lies in need for an intermediate component between the prime mover and door panel. At a time where system reliability is an increasingly important factor in choosing door systems, the use of a prime mover such as a linear induction motor which directly drives the panels, essentially eliminates much of the intermediate linkages, thereby substantially increasing the reliability of the overall system.

Linear induction motor (LIM) drives have been proposed as door panel drives for some time. U. S. Pat. No. 1,950,627 discloses and claims such a system. However, as disclosed in U.S. Pat. No. 1,950,627 the system as disclosed, generally speaking, would be inoperative and/or impractical due to the space and power limitations currently present in mass transit vehicles.

Further, previous innovations disclosed under prior art patents using LIM drives did not contemplate other requirements mandated by public transportation car manufacturers and municipal or federal authorities. Additional requirements such as: reliable mechanical lock device, immunity against iron dust with simplified mechanical design resulting in reduced maintenance, ability to conform to a restricted mounting space and envelope, door panel obstruction detection capability, reliable emergency door opening mechanism and smooth door opening and closing speed profile.

Applicant, however, has discovered an approach to integrating presently available linear induction motors into modern complex door control systems required by today's transit authorities.

It is, therefore, an object of the invention disclosed herein to provide a door control system for mass transit vehicles wherein the combination of electrical control and door drive components has high reliability through reduction in the number of components employed.

It is an additional object of the invention to provide a door drive wherein the prime mover drive forces are directly applied to the drive panel.

It is a further object of the invention disclosed herein to provide a door drive prime mover wherein components intermediate the prime mover energy source and drive door panel are reduced to one moving part.

It is yet an additional object of the invention to provide an electronic control for a linear induction motor door drive wherein door edge force and door speed are controlled with direct electromechanical devices.

It is an additional object of the invention to provide a door drive incorporating a LIM motor having drive powered door opening lock.

SUMMARY OF THE INVENTION

A double side linear induction motor is used to move a public transportation car door. A closed control loop via a variable voltage, variable frequency inverter and a computerized algorithms or other suitable control modes, including pulse width modulation of the LIM prime mover, achieve the desired speed/travel profile of the door panel motion. The total weight of the door is supported by a linear bearing hanger. A sealed rotary incremental optical encoder actuated by the LIM motor transport part or rod indicates, through use of algorithms, the instantaneous door panel position. Door signals from the encoder are processed to get the door panel speed information.

A mechanical device integrated into the LIM transport rod assembly ensures locking the door panel at fully closed position. Unlocking this latter mechanism is achieved by the further motor transport part movement. A mechanical limit switch is mounted on the lock mechanism to inform the control algorithms on the door status.

A double side linear induction motor is mounted overhead of, and magnetically coupled to, a movable door panel. The panel is independently attached to a suitable hanger and the hanger in turn is journaled for motion along a door panel support.

The linear induction motor stator or stationary component is suitably attached to the car structure overhead and adjacent to the door hanging system. The linear induction motor transport rod or movable armature is attached to the above described hanger. Since the transport rod moves only parallel to the half of the door traveled, efficiency of the drive is high and requires no intermediate components.

As coupling between the linear induction motor stator and transport rod is magnetic, door panel breakaway force is limited and controllable independent of the door speed. This feature reduces potential passenger hazards and mechanical wear on the overall drive system.

Movement and location of the transport rod is sensed and indicated by a simple counter operated by a portion of the transport rod. Operation of the door drive by the linear induction motor drive is therefore controllable by relative simple, highly reliable electrical components including relays and/or power electronic devices.

A novel lock secured to the linear induction transport rod secures the rod and thereby the door panel to the operator base plate through the action of a spring latch carried on the transport rod and a lock pin on the baseplate after panel locking. Unlocking is achieved by lost motion of the latch in relation to the transport rod when driven in the door opening direction after locking has been completed.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

Figure 1:
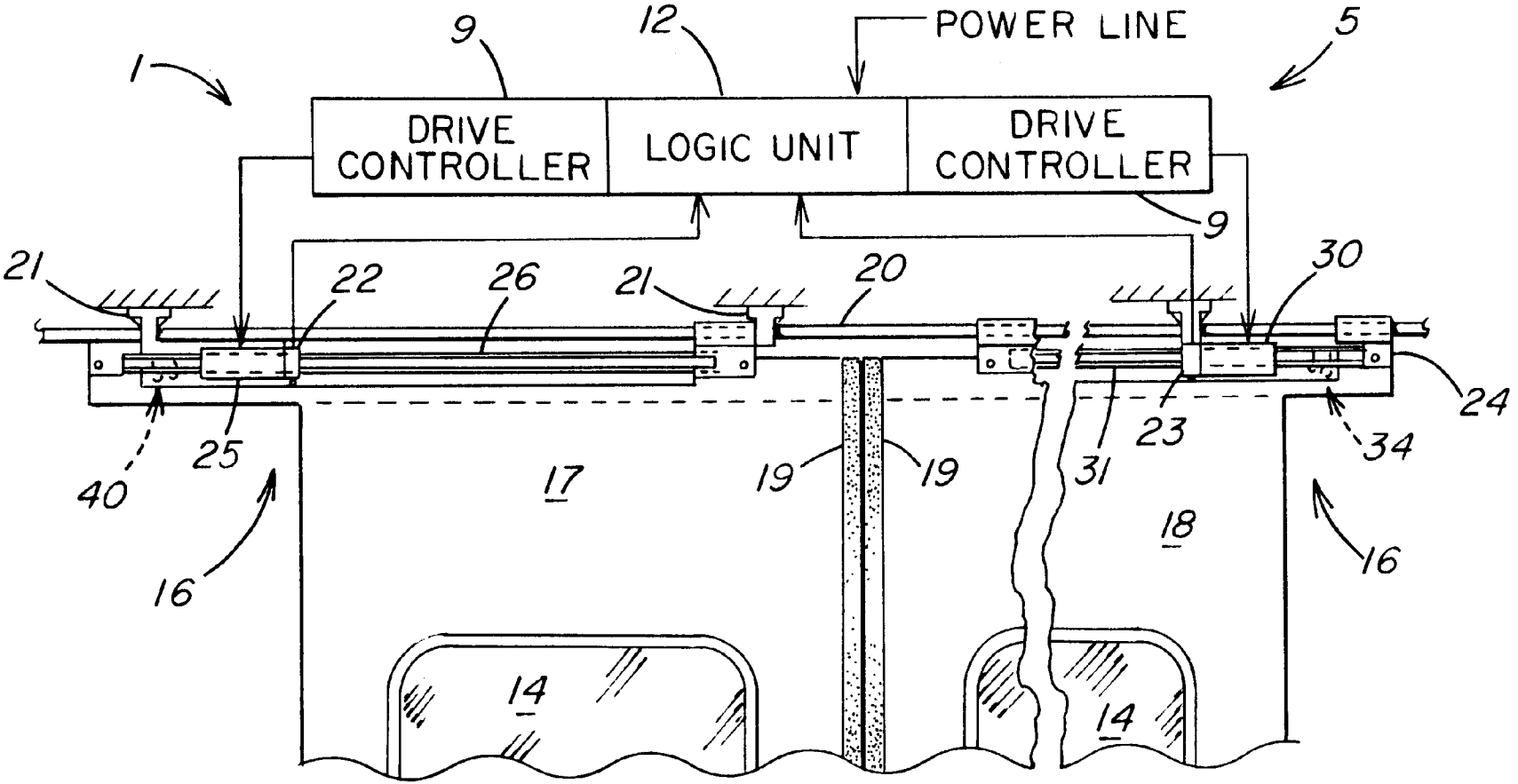
FIG. 1 is a pictorial block diagram showing a configuration of the invention utilized to drive by-parting sliding doors, including a diagrammatic showing of the location of the door locks and door position sensor for a door closed condition.
Figure 2:
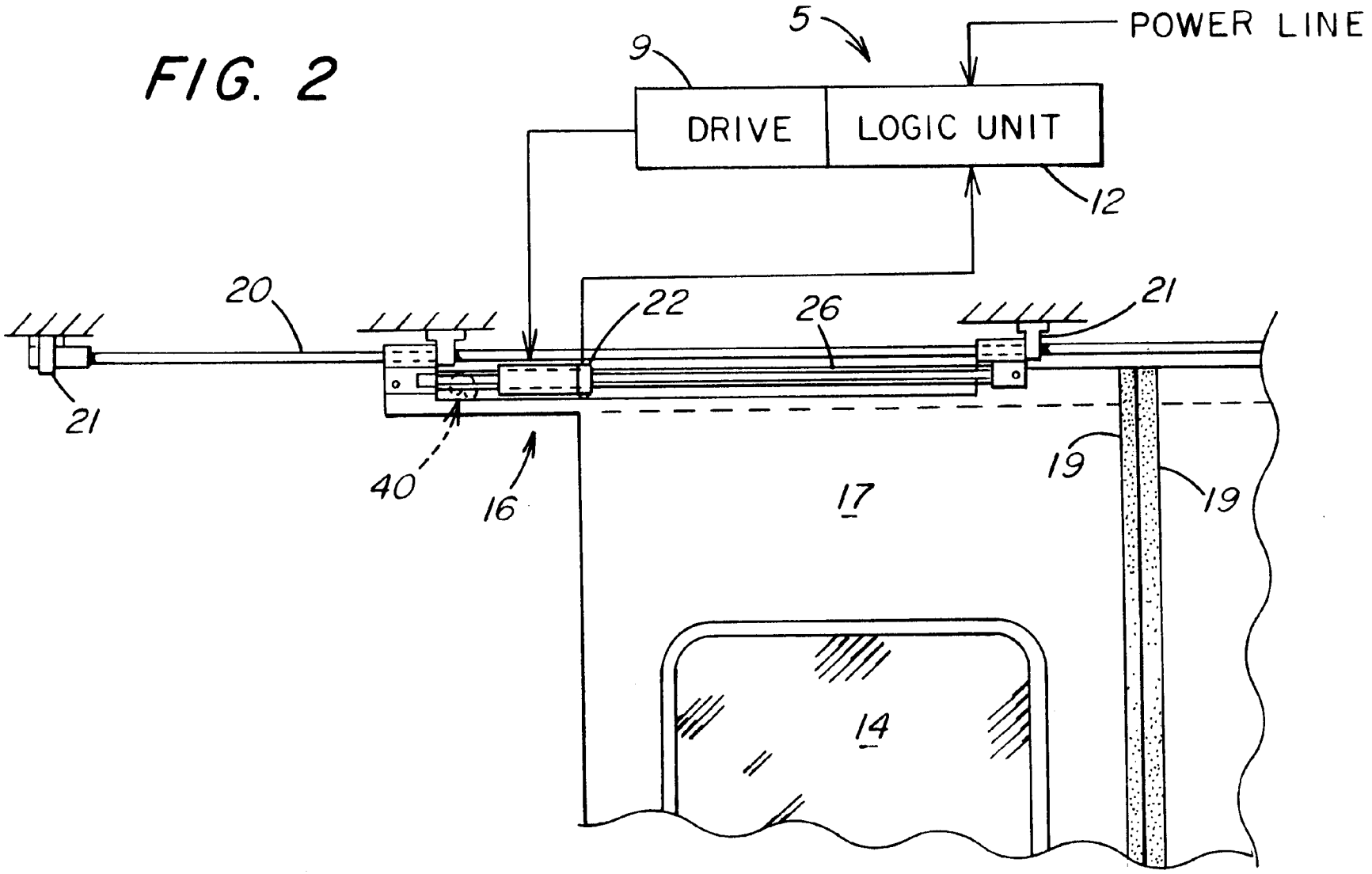
FIG. 2 is a pictorial block diagram particularly showing a view of the left hand door of FIG. 1 with the operator in place, particularly showing a complete hanger.
Figure 3:
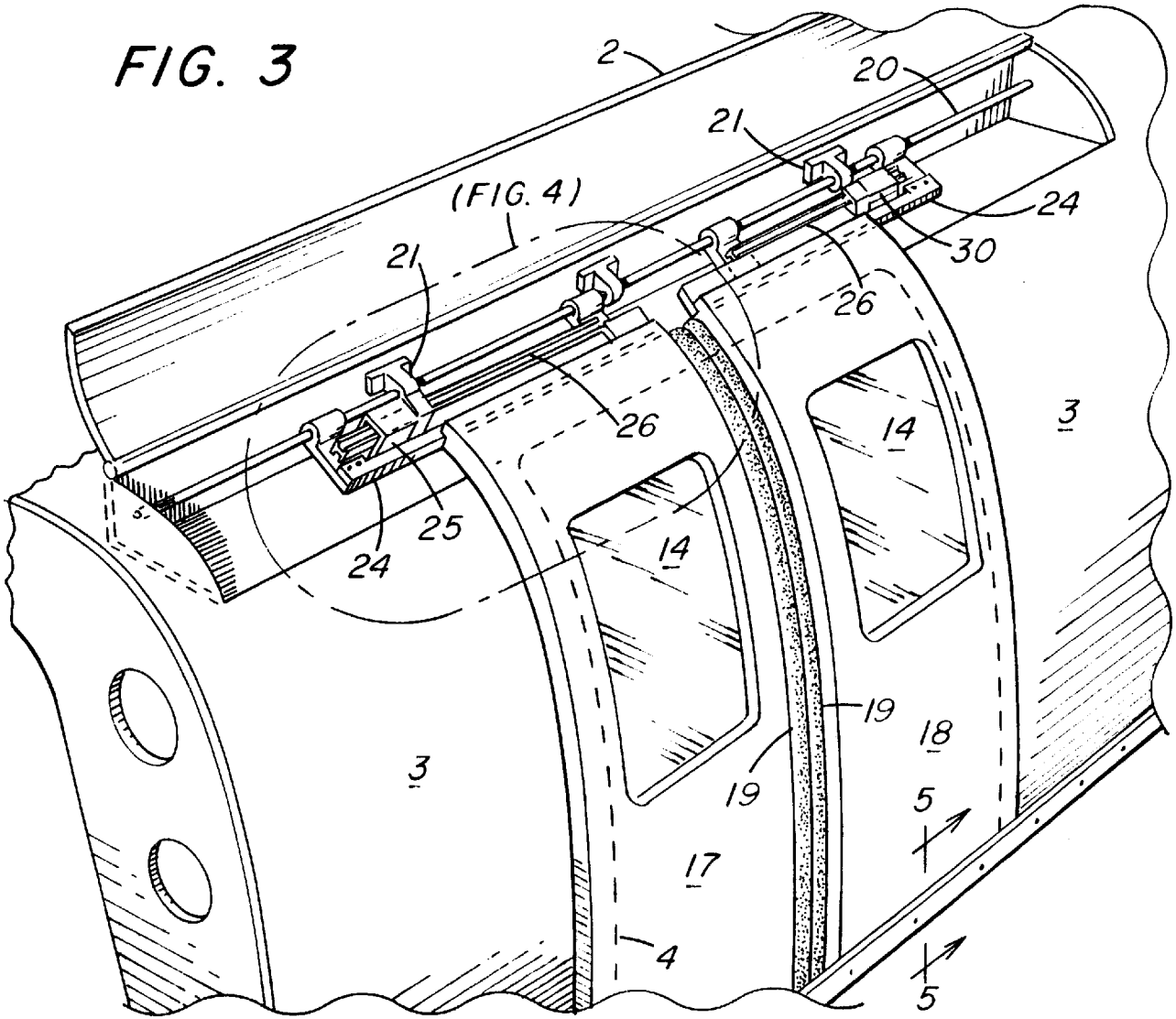
FIG. 3 is a perspective view of the door drive of the invention in situ, partially showing a transit vehicle wherein the door drive is located in the transit car overhead.

In reference to FIGS. 1 and 2, there is shown in semi-diagrammatic form a door drive system 1 including a door controller 5 having a logic unit 12 and individual panel drive controllers 9. The drive unit 5 provides controlled power to a linear induction motor door drives 16, thereby moving door panels 17 and 18, over and away from an aperture in a car body 3 (reference FIG. 3). Panels 17 and 18 include windows 14 and sealing edges 19. Panels 17 and 18 are further slidably mounted for motion over and away from an aperture in the car body through upper end attachment via door hangers 24 to a door hanger rod 20. The door hanger rod 20 is attached to the car body 3 via hangers 21.

Reciprocal motion of doors 17 and 18 over an aperture 4 in the car body 3 is obtained through force exerted by linear induction motor (LIM) actuator assemblies 16 via a LIM transfer rod 26, also attached to door hanger 24. Information relating to the position of each door panel 17 or 18 is transmitted to the logic unit 12 via a suitable distance measuring transducers 22 and 23, thereby supplying the controller 5 with information describing door panel travel when powered by LIM actuators 25 and 30.

Figure 5:
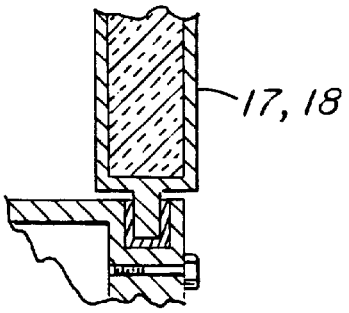
FIG. 5 is a partial section along line 5—5 of FIG. 3, particularly showing the guide/support structure for sliding doors as disclosed.
Figure 4:
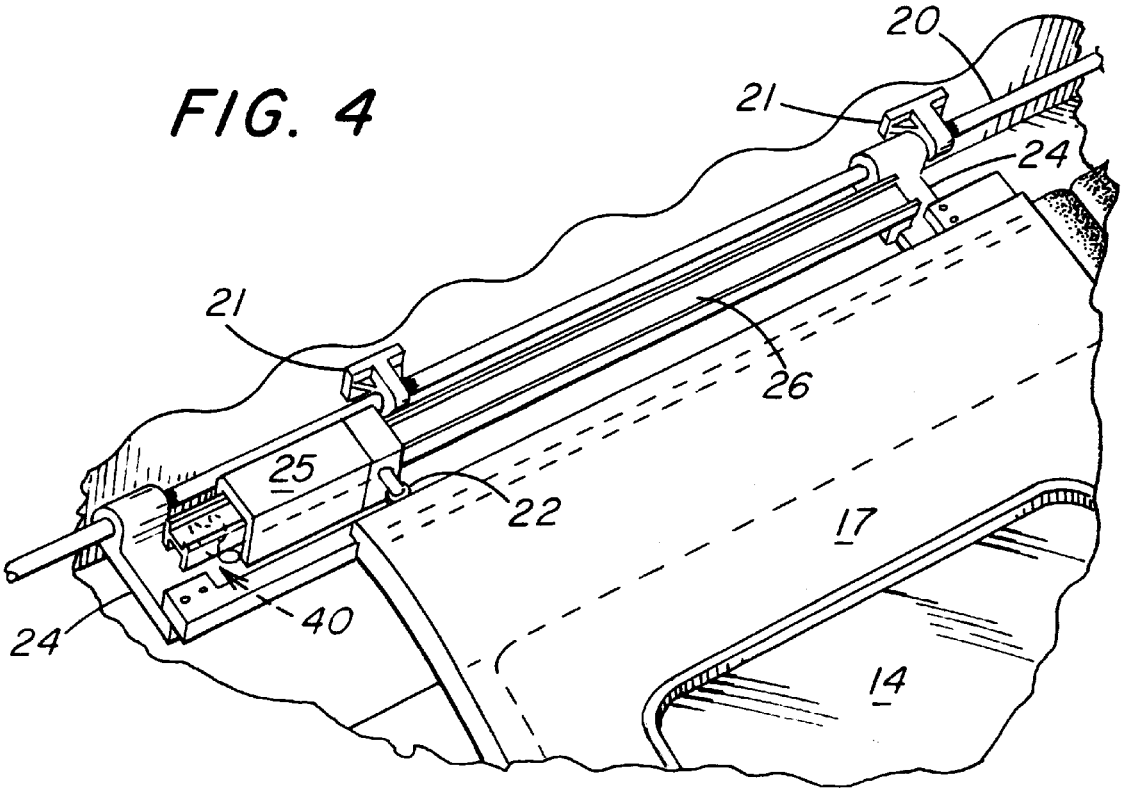
FIG. 4 is a partial or tearaway section of FIG. 3 showing the operator of the invention in position over the door of FIG. 2 for a door closed condition, particularly showing the linear induction motor, its transport rod and associated motion sensor, attached to one door panel in a door closed and locked condition.
Figure 6:
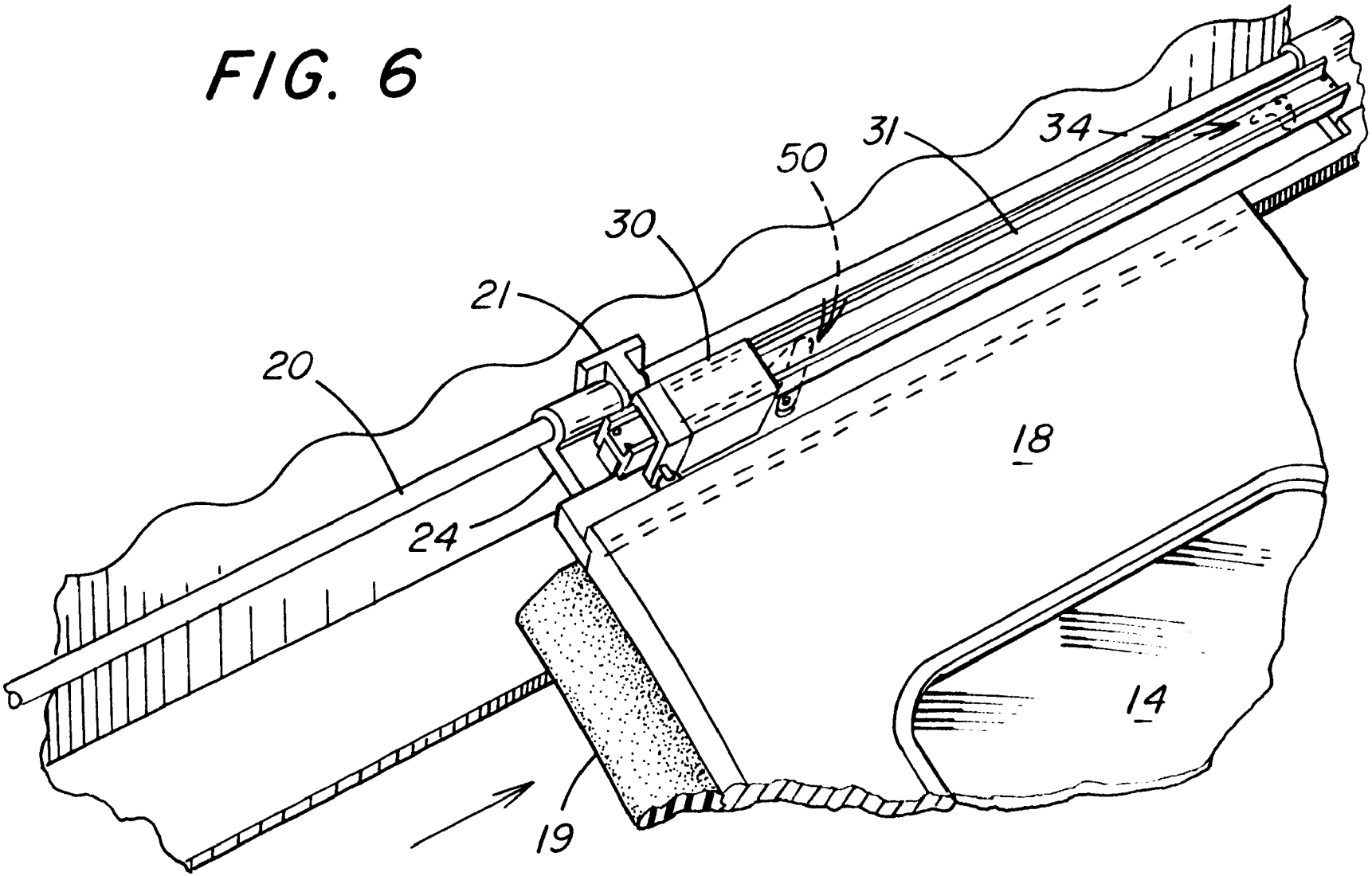
FIG. 6 is a partial view of the door drive of the door system of FIG. 1, particularly showing the relationship between the linear induction motor drive transport rod and lock members for a single door panel in a door open position.
Figure 7:
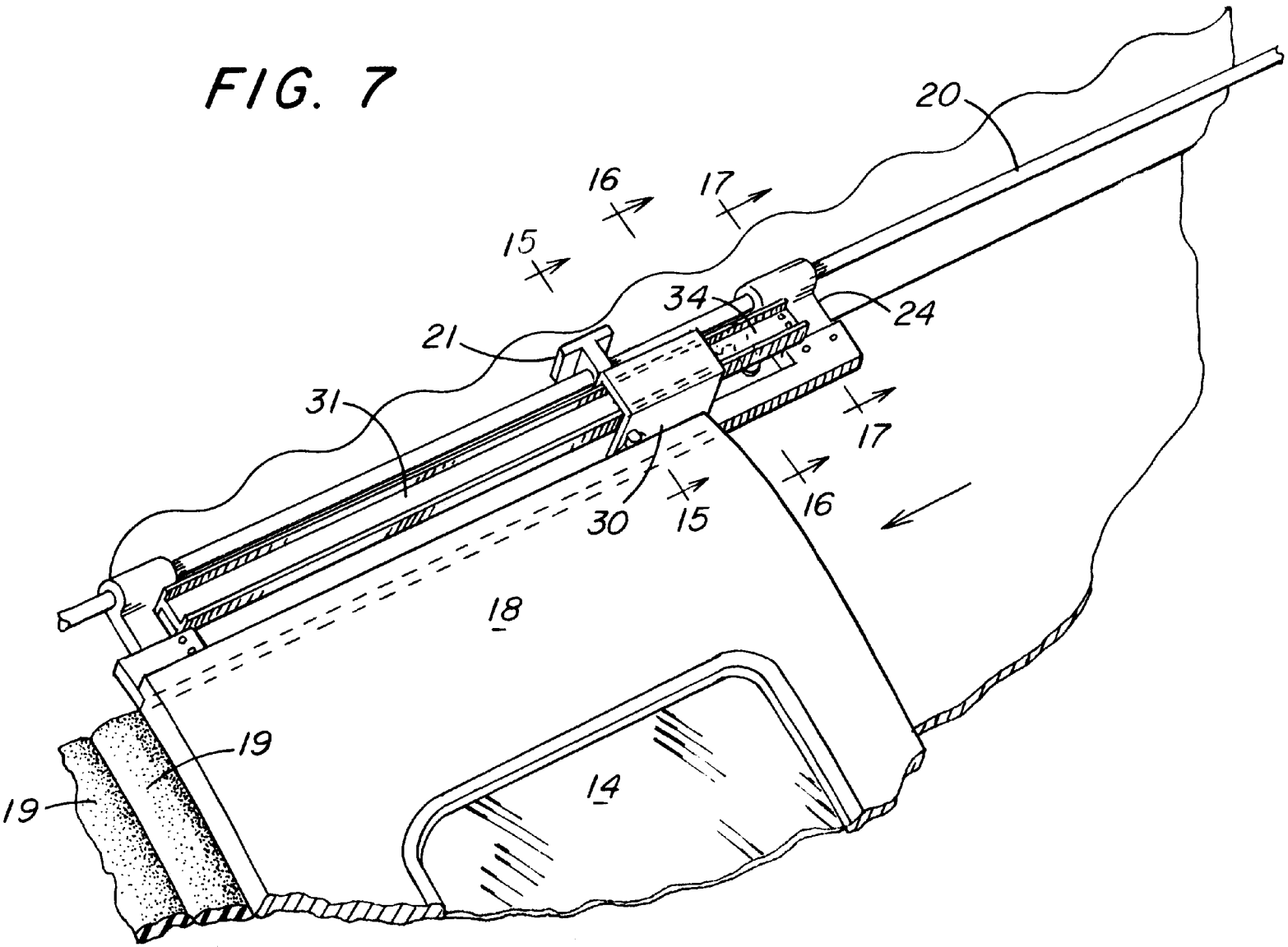
FIG. 7 is a further view of the door panel of FIG. 6 in a door closed position.

In more particular reference to FIGS. 4, 5 and 6, the lower edge of door panels 17 and 18 is slidably contained in a slot (reference FIG. 5) in the car body 3. In reference to FIG. 4, with the door panel 17 in a fully closed position, the transfer rod 26 of LIM actuator 25 has moved door lock assembly 40 into a locked condition, securely maintaining panel 17 in a door closed position. Similarly, (reference FIG. 7) right hand LIM actuator 30 has, in moving panel 18 to a closed position, extended LIM transfer rod 26 and actuating lock assembly 34, thereby maintaining door panel 18 in a securely closed position.

Figure 11:
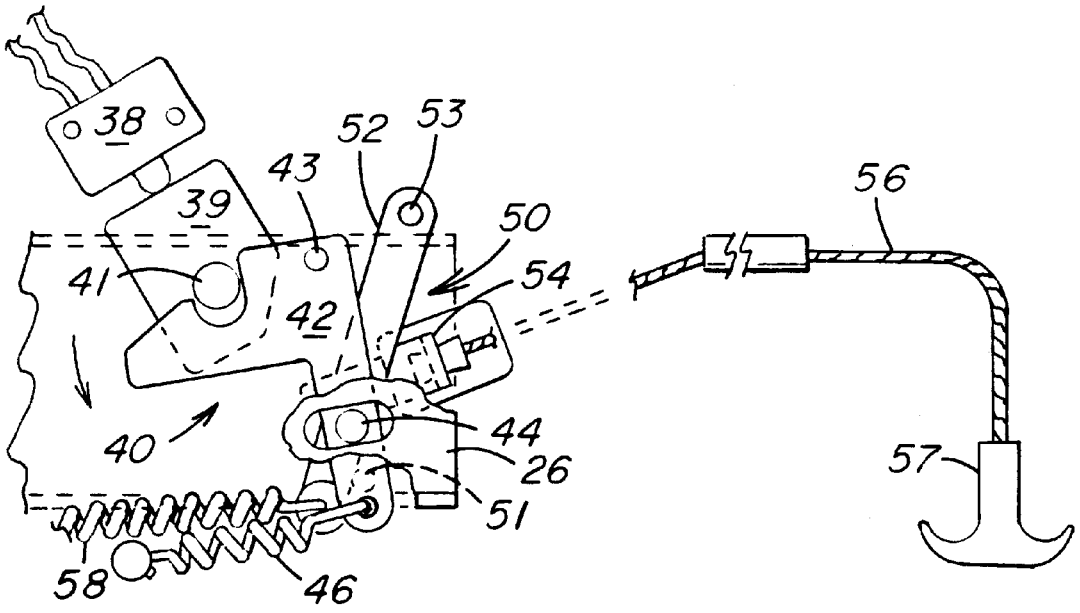
FIG. 11 is a further partial view of the lock components of FIG. 10, particularly showing operation of the emergency cable release from a locked condition.
Figure 12:
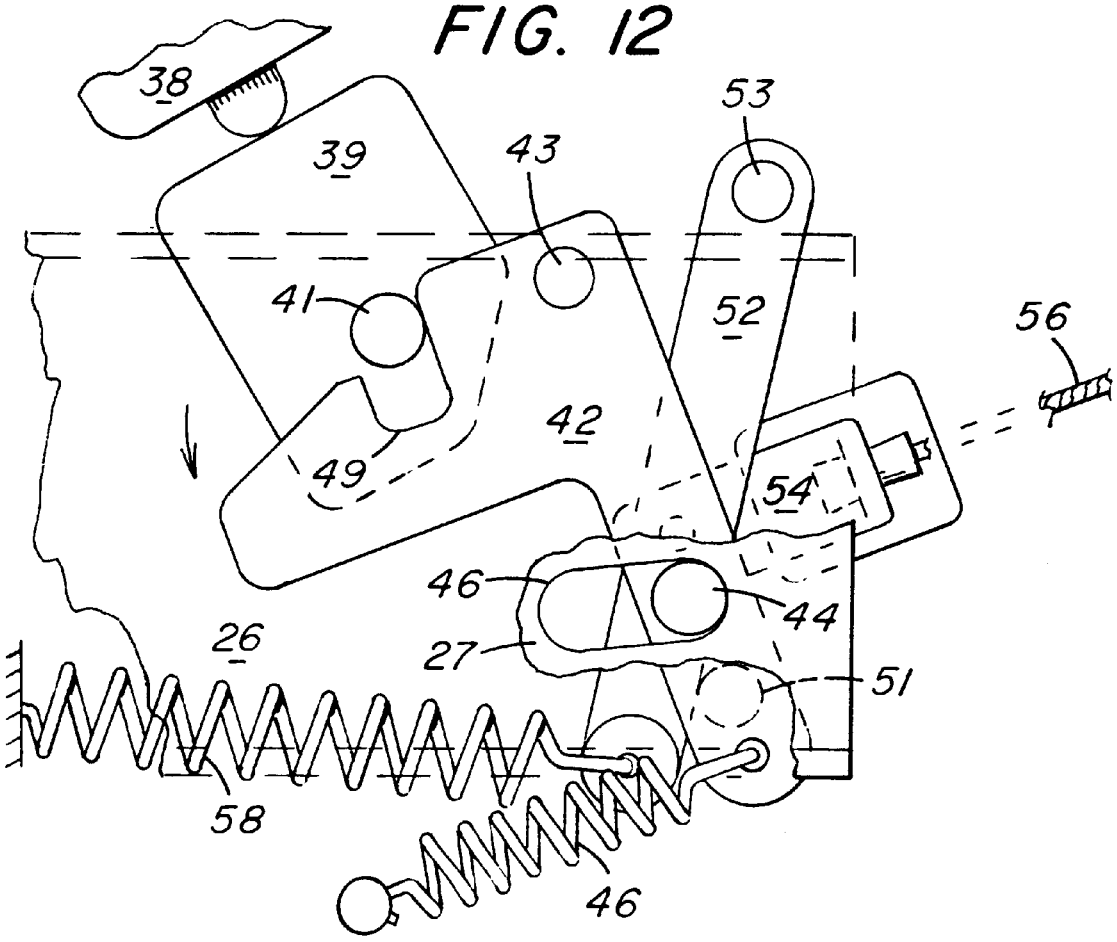
FIG. 12 is an additional partial view of the lock components of FIG. 11, particularly showing unlocking by action of the emergency cable.

Incorporated and adjacent to lock assembly 34 is a manual door lock release assembly 50 (reference FIGS. 6 and 11). Since the operation of the manual door release assembly involves operating elements of the primary door lock assembly 40, description of the interaction will proceed as adjunct to operation of the primary lock assembly 40. It should be noted that as the right hand and left hand lock assemblies are identical, other than a reversal of parts for each individual LIM door drive, the following description will proceed by following movement of the right hand panel 18 from a fully opened position (reference FIG. 6) to a fully closed position (reference FIG. 7).

It should also be noted that positioning of door lock and manual unlock components on opposite sides of the LIM actuator transfer rod 26 require occasional referral to exploded and detailed drawings of the lock components and interrelations depicted on FIGS. 11, 12, 13, and 14.

Figure 8:
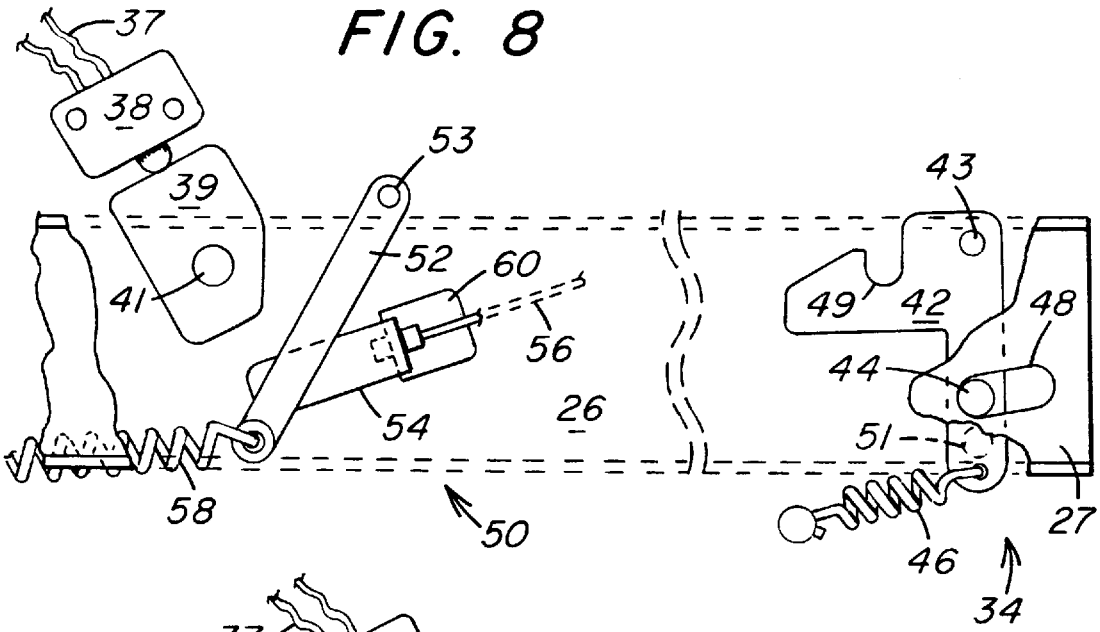
FIG. 8 is a partial view of the door system panel lock and manual panel release assemblies showing the panel lock components as associated with the LIM transport rod and operator baseplate for a panel unlocked condition.
Figure 13:
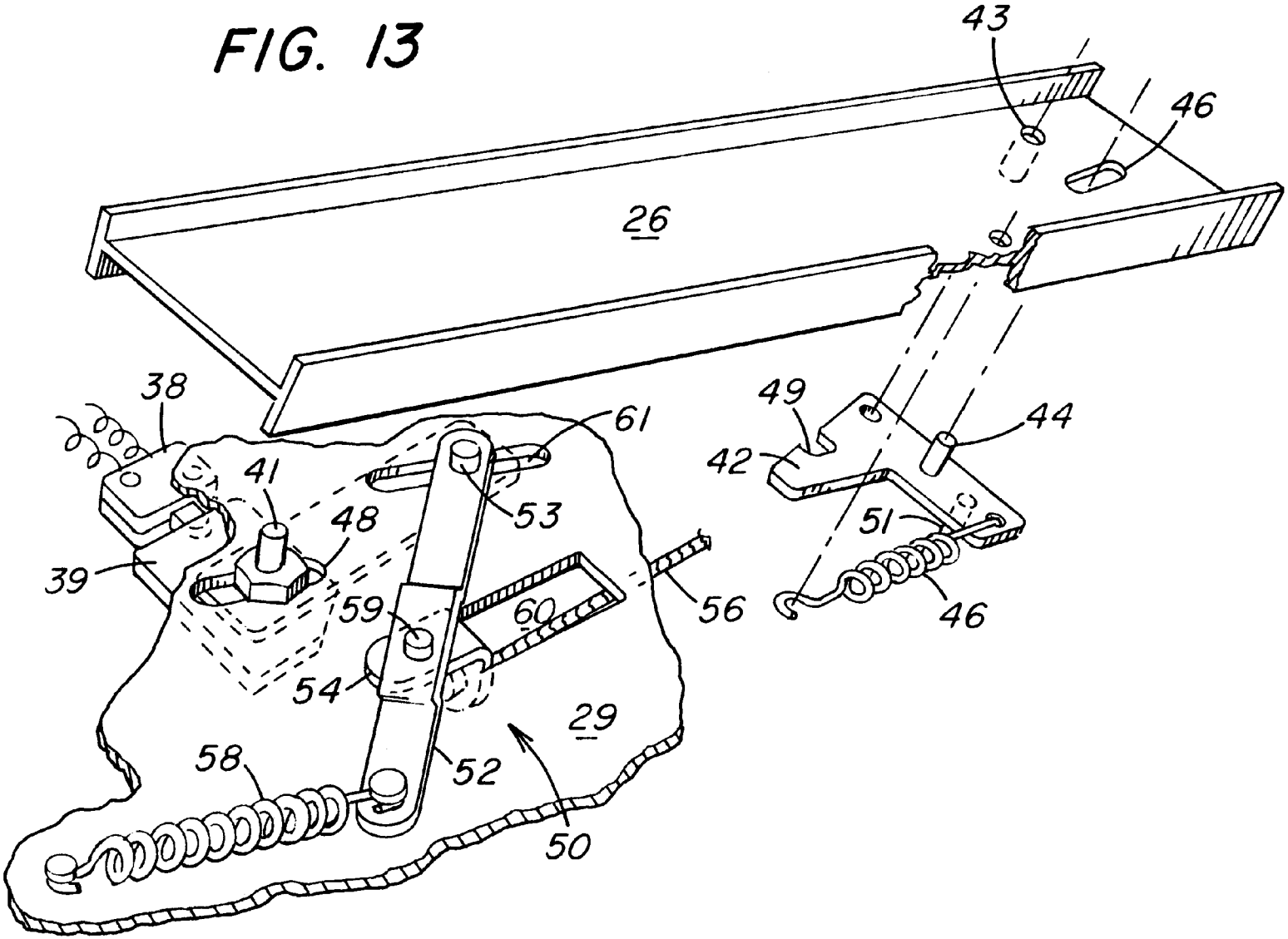
FIG. 13 is an exploded partial tearaway view of the lock and emergency release mechanism, particularly showing spatial relationship of lock components and the operator baseplate.
Figure 14:
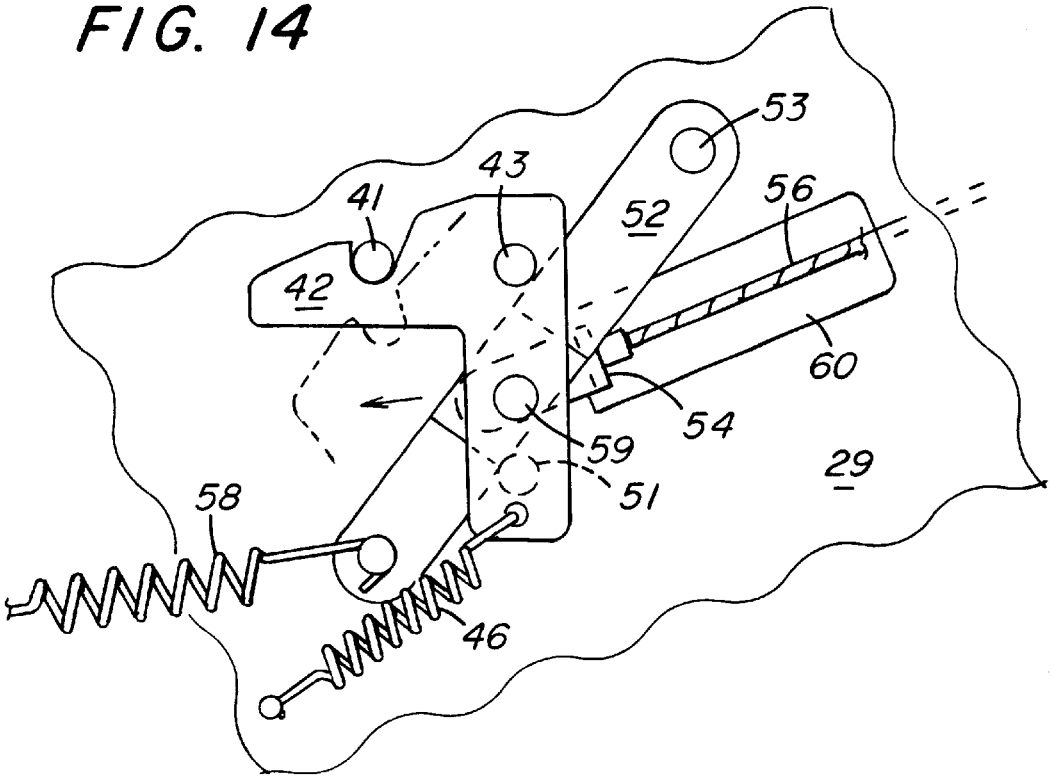
FIG. 14 is a further partial tearaway view of the emergency mode of components, particularly showing emergency unlocking.
Figure 15:
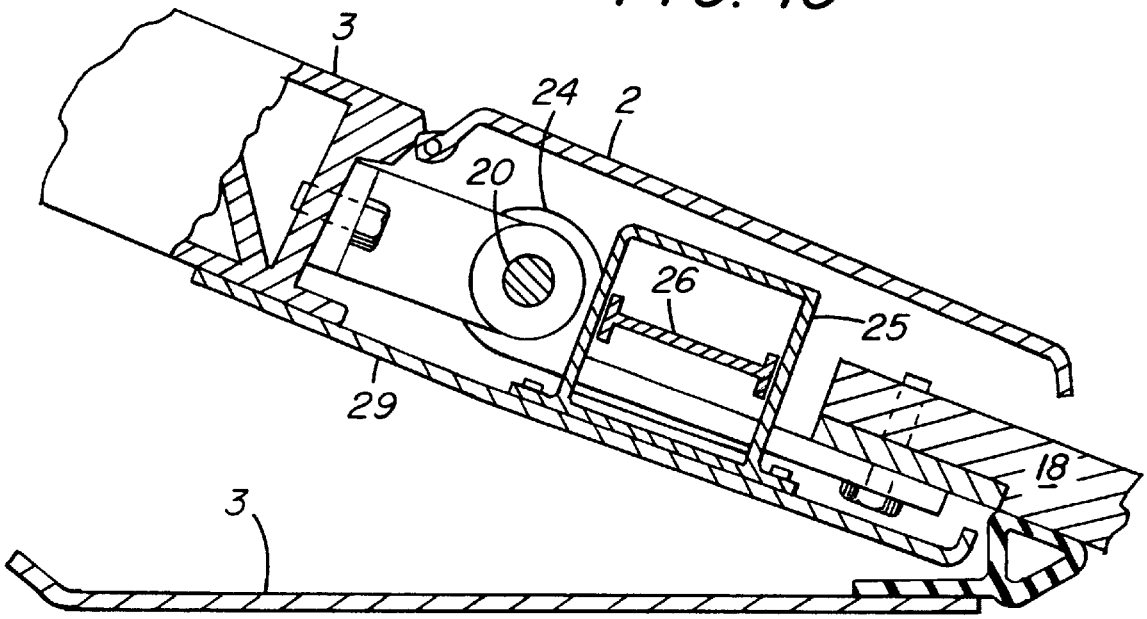
FIG. 15 is a sectional view of the operator of the invention in place above the opening of FIG. 3, and along line 15—15 of FIG. 7, particularly showing door hanger, LIM components, and transfer rod.

Door lock and manual unlock assemblies 34 and 50 for panel 18 in a fully opened position are best shown in FIG. 8 with further reference to exploded and detailed component drawings shown in FIGS. 13 and 14. With reference to FIG. 8, there is shown lock pawl 42 mounted for rotatable movement on and along lateral movement of transfer rod 26 by pivot pin 43. Additional movement of lock cam 42 around pivot pin 43 is restrained by unlock pin 44 acting through aperture 48 in transfer rod surface 27 (partially shown). Lock cam 42 is also controlled by spring 46 affixed to the lower end of lock cam 42 and attached to transfer rod 26 so as to maintain a predetermined rotational force bias on the position of lock cam 42 as retained by the combination of pin 44 and slot 48 (as shown in FIG. 8).

Figure 16:
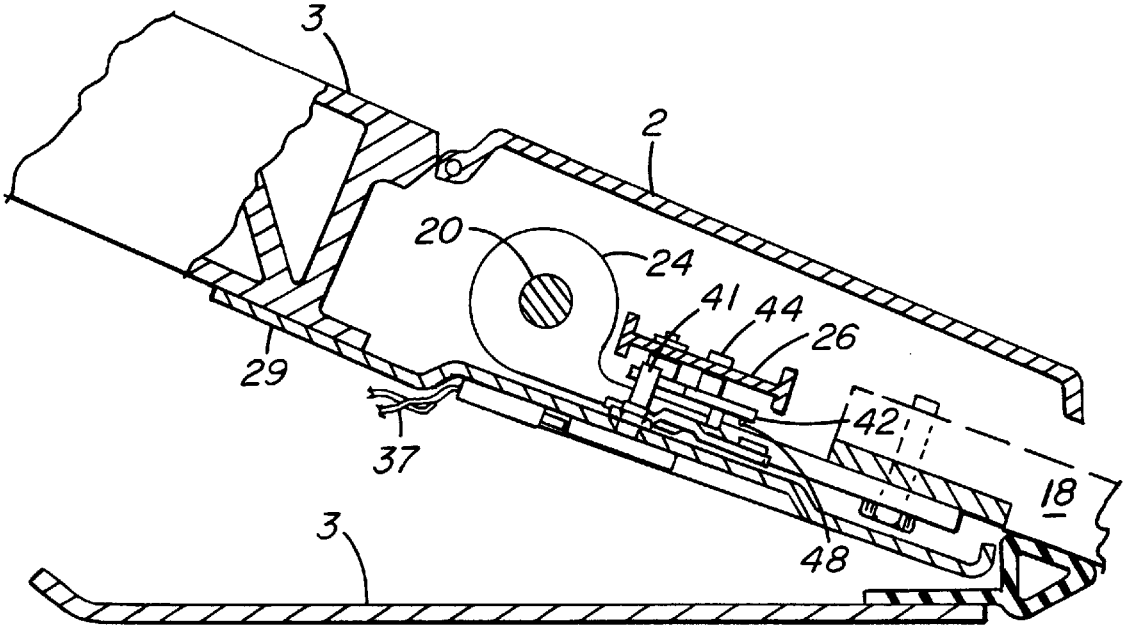
FIG. 16 is a further sectional view of the operator along line 16—16 of FIG. 7, particularly showing the LIM transfer rod operator baseplate and lock components.
Figure 17:
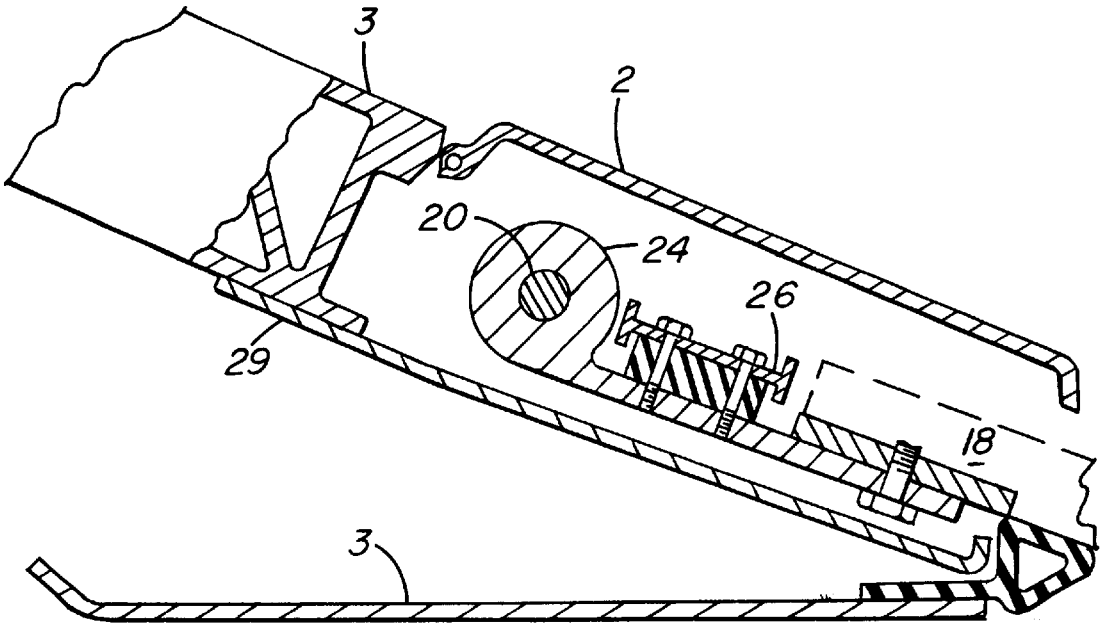
FIG. 17 is a further sectional view of the operator along line 17—17 of FIG. 7, particularly showing the LIM transfer rod attached to the door hanger.

Adjacent the opposite end of transfer rod 26, lock pin 41 is suitably attached to the operator base plate 29 (reference FIGS. 13 and 16). Also attached to base plate 29 (reference FIG. 13) is limit switch bracket 39 and limit switch 38 (as shown). Limit switch 38 includes a suitable operating arm in order to co-act with the lock cam 42, thereby signaling the door in a fully closed position.

The manual release assembly 50, essentially attached to base plate 29 includes a door release actuating arm 52 mounted for pivotal motion around pin 53. Pivotal motion of arm 52 is controlled by bias spring 58, maintaining the arm in an unactuated position. Located at an appropriate position along arm 52 there is a bracket 54 rotatably attached to arm 52 by pivot 59. Bracket 54 is contained in baseplate slot 60. The opposite end of bracket 54 has one end of release cable 56 attached thereto. Slot 61 in baseplate 29 is provided for adjustment of the manual release assembly operation. Similarly, slot 48 in baseplate 29 is provided for adjustment of the operating position of lock pin 41 when coacting with lock cam 42. The significance of this will be discussed below.

Turning to FIG. 8, operating elements of primary lock assembly 34 are shown in door open, unlocked condition. Lock cam 42 is shown with its unlock pin 44 engaged in the furthermost left hand position of slot 48. Spring 46 provides a predetermined amount of force maintaining cam 42 (as shown) and ensuring that future lock condition is maintained.

Figure 9:
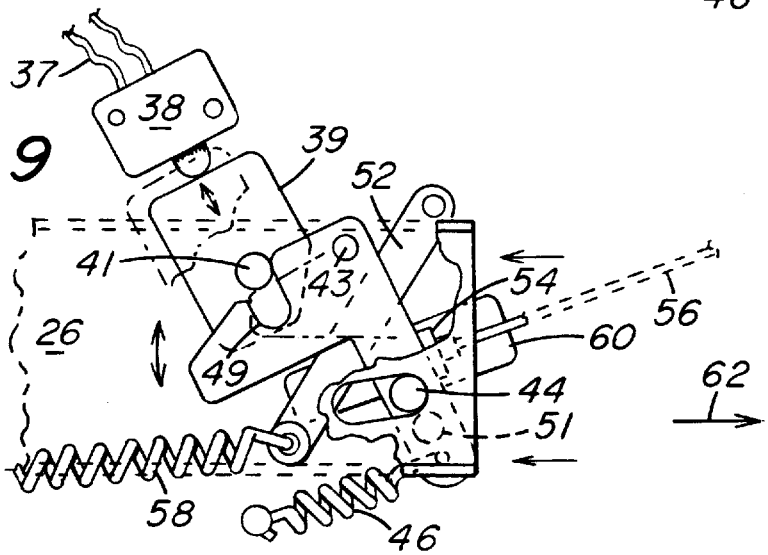
FIG. 9 is a view of the panel lock components of FIG. 8, for a closed panel condition with lock components immediately prior to a fully locked condition.
Figure 10:
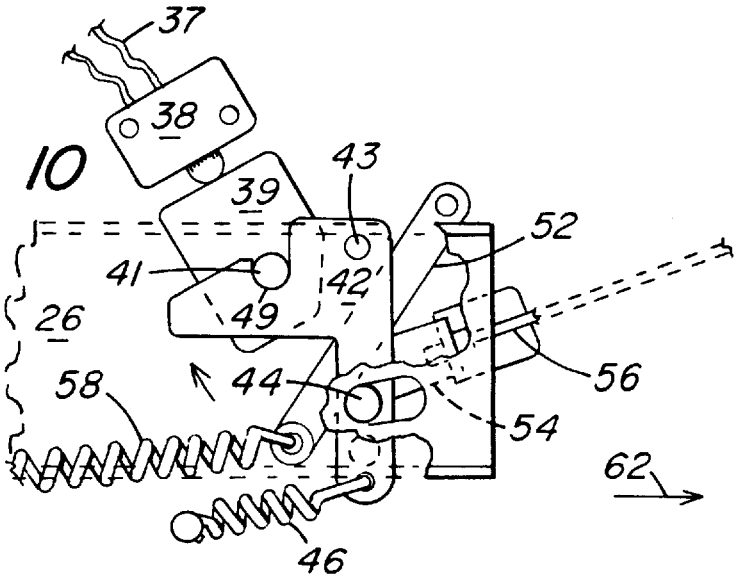
FIG. 10 is a further view of the lock components of FIG. 9, particularly showing the lock in an engaged condition.

Turning now to FIG. 9 where the transfer rod 26 has moved the left hand panel into a door closed position by actuation of the LIM actuator 25, lock pin 41 has rotated cam 42 around pivot 43 in a counterclockwise direction allowing lock pin 41 to enter lock pin slot 49. In FIG. 10, the locking action has been completed with lock pin 41 securely held in slot 49 through the action of spring 46. Note that unlock pin 44 has returned to its initial position shown in FIG. 8. This essentially completes the locking action of the door drive system.

Unlocking of the previously locked door panel is obtained by energizing the LIM actuator so as to propel the transfer rod 26 in a direction 62 opposite to that shown in FIG. 9. Movement of transfer rod 26 in a direction 62 (reference FIGS. 9 and 10) exerts a force against lock pin 41 and the left hand edge of slot 49 in lock cam 42. When the force 62 exceeds a predetermined value, a force couple developed between lock pin 41 affixed to the operator baseplate and pivot 43 affixed to the transfer rod 26 provides counterclockwise rotation of cam 42 such that pin 44 moves to the right hand portion of slot 48 in transfer rod 26 (reference FIG. 9). The counterclockwise rotation of cam 42 disengages lock pin 41 and slot 49, thereby allowing transfer rod 26 to move toward an open position (reference FIG. 6). Operation of the right hand or opposite panel of the door system of the invention is identical and will not be separately described.

Operation of the manual door lock release is accomplished through the action of pivoting lever 52 (reference FIG. 11) in response to a force exerted on member 54 contained in slot 60 for limited movement therein (reference FIG. 13) and pivotally attached to lever 52 at pivot 54. On application of force from cable 56 through handle sufficient to overcome the force exerted on the lower end of lever 52 by spring 58, lever 52 rotates around pivot 53 attached to baseplate 29, into a position where it contacts unlock pin 51 (reference FIGS. 13 and 14). Further movement of cable 56 at a predetermined force rotates lock cam 42 around pivot 43 within the limits provided by slot 48 in the transfer rod 26. Movement of unlock pin 51 such that door unlock pin 44 occupies the position shown in FIG. 9, wherein lock pin 41 and slot 49 are disengaged, allowing manual movement of door panels to an open position.

What is claimed as new and desired to be secured by Letters Patent of the United States is:

1. A sliding door system for use in opening and closing a doorway of a transit vehicle comprising:

a baseplate engageable with such transit vehicle for mounting at least one door panel thereon so that said door panel is capable of being moved reciprocally between open and closed positions of such doorway;

a linear induction motor attached to said baseplate;

a transfer rod extendible from said linear induction motor, said transfer rod conveying a force generated by said linear induction motor to move said door panel between such open and closed positions upon energization of said linear induction motor;

primary means disposed at one end of said transfer rod for locking said door panel in such closed position when said door panel is moved thereto;

secondary means attached to said baseplate approximate said linear induction motor for acting with said primary means in locking said door panel in such closed position;

such that by energizing said linear induction motor to move said transfer rod (i) completely in one direction causes said primary means and said secondary means to coact to lock said door panel in such closed position and (ii) initially in an opposite direction causes said primary means and said secondary means to coact to unlock said door panel without movement of such door panel.

2. The sliding door system of claim 1 further comprising:

means for energizing said linear induction motor so as to enable said linear induction motor to move said transfer rod and said door panel therewith between said closed position and said open position; and lost motion means, in said primary means, for enabling said door panel to be unlocked on initial energization of said linear induction motor.

3. The sliding door system of claim 1 or 2 wherein:

said primary means includes a lock pawl pivotally mounted on said one end of said transfer rod, said lock pawl featuring an unlock pin mounted thereto; and, said secondary means includes a lock pin mounted on said baseplate; and, said lost motion means includes a slot in said transfer rod into which said unlock pin of said lock pawl projects wherein said slot coacts with said unlock pin therby providing restricted lost motion as rotation of said lock pawl is limited by said slot in said transfer rod.

said primary means includes lock pawl pivotally mounted on said one end of said transfer rod, said lock pawl featuring an unlock pin mounted thereto; and, said secondary means includes a lock pin mounted on said baseplate; and, said lost motion means includes a slot in said transfer rod into which said unlock pin of said lock pawl projects wherein said slot coacts with said unlock pin thereby providing restricted lost motion as rotation of said lock pawl is limited by said slot in said transfer rod.

4. A door and door drive system for a transit vehicle having an opening in a side wall thereof, said door and door drive system comprising:

a door panel;

a baseplate engageable with said door panel and having a lock pin mounted thereto;

a linear induction motor mounted to said baseplate;

a transfer rod extendible from said linear induction motor, said transfer rod being interconnected to said door panel and defining approximate one end thereof a slot;

a lock pawl pivotally mounted for limited lost motion on said one end of said transfer rod, said lock pawl featuring an unlock pin mounted thereto that projects into said slot of said transfer rod so as to limit rotation of said lock pawl between a neutral position and a fully disengaged position;

means for biasing said lock pawl in said neutral position;

means for selectively energizing said linear induction motor so as to move said transfer rod and said door panel therewith between open and closed positions over such opening in such side wall of such transit vehicle;

such that selectively energizing said linear induction motor to move said transfer rod in one direction eventually causes said lock pawl on said transfer rod to rotate to said fully disengaged position due to contact with said lock pin of said base plate and then to lockingly engage said lock pin by reassuming said neutral position thereby locking said door panel in such closed position.

5. The door drive system of claim 4 wherein selective energization of said linear induction motor to move said transfer rod initially in an opposite direction causes said lock pawl on said transfer rod to rotate out of said neutral position due to disengagement of said lock pin therefrom thereby enabling said door panel to be unlocked without movement of said door panel.

6. The door drive system of claim 5 wherein said linear induction motor when selectively energized to move said transfer rod fully in said opposite direction causes said transfer rod and said door panel therewith to assume said open position.

7. A lock assembly for a door drive system for a transit vehicle, such door drive system having a baseplate mountable on such transit vehicle, a linear induction motor mounted on such baseplate and a transfer rod extendible therefrom, such linear induction motor via such transfer rod being capable of reciprocally moving a door panel between open and closed positions over an opening in a side wall of such transit vehicle, such transfer rod having a slot defined approximate one end thereof, said lock assembly comprising:

(a) a lock pin engageable with such baseplate;

(b) a lock pawl pivotally engageable with such one end of such transfer rod for limited lost motion thereon, said lock pawl (i) featuring an unlock pin mounted thereto that projects into such slot of such transfer rod so as to limit rotation of said lock pawl between a neutral position and a fully disengaged position and (ii) defining a lock pin slot; and (c) a means for biasing said lock pawl in said neutral position; such that selectively activating such linear induction motor to move such transfer rod (i) fully in one direction causes said lock pawl to rotate to said fully disengaged position due to contact with said lock pin on such baseplate and then to lockingly engage said lock pin within said lock pin slot thereof by reassuming said neutral position thereby locking such door panel in such closed position and (ii) initially in an opposite direction causes said lock pawl to rotate out of said neutral position due to disengagement of said lock pin from said lock pin slot thereof thereby enabling such door panel to be unlocked while still remaining in said closed position.

* * * * *